US006391836B1

(12) United States Patent
Haydu et al.

(10) Patent No.: US 6,391,836 B1
(45) Date of Patent: May 21, 2002

(54) BIOLOGICAL CLEANING SYSTEM WHICH FORMS A CONVERSION COATING ON SUBSTRATES

(75) Inventors: Juan Haydu, Orange; Timothy P. Callahan, Shelton; Zoltan F. Mathe, Easton; Mikael Norman, Branford, all of CT (US)

(73) Assignee: BioClean, USA, Bridgeport, CT (US)

( * ) Notice: Subject to any disclaimer, the term of this patent is extended or adjusted under 35 U.S.C. 154(b) by 0 days.

(21) Appl. No.: 09/761,462

(22) Filed: Jan. 16, 2001

(51) Int. Cl.[7] ..... C11D 3/36

(52) U.S. Cl. ..... 510/218; 510/234; 510/220; 510/228; 134/26; 134/36; 134/50; 134/84; 134/88; 134/91; 134/94.1; 134/95.1; 134/99.2; 134/102.2; 134/186

(58) Field of Search ..... 510/218, 234, 510/220, 228; 134/26, 36, 50, 84, 88, 91, 94.1, 95.1, 99.2, 102.2, 186

(56) References Cited

U.S. PATENT DOCUMENTS

| | | | | |
|---|---|---|---|---|
| 3,843,464 A | | 10/1974 | Usami et al. | |
| 3,923,540 A | | 12/1975 | Usami et al. | |
| 4,655,794 A | | 4/1987 | Richardson et al. | |
| 5,108,544 A | | 4/1992 | Hakansson | |
| 5,314,620 A | | 5/1994 | Staniec | |
| 5,322,078 A | | 6/1994 | Tuttle | |
| 5,492,139 A | * | 2/1996 | Lashmett et al. | 134/111 |
| 5,532,162 A | | 7/1996 | Aamot | |
| 5,589,004 A | | 12/1996 | Lashmett et al. | |
| 5,772,782 A | | 6/1998 | Lashmett et al. | |
| 5,931,174 A | | 8/1999 | Salas et al. | |
| 5,961,733 A | | 10/1999 | Strange | |
| 6,016,818 A | | 1/2000 | Evaro et al. | |
| 6,019,110 A | | 2/2000 | McClure et al. | |
| 6,044,854 A | | 4/2000 | Marks | |
| 6,063,206 A | | 5/2000 | Latta | |
| 6,074,491 A | | 6/2000 | McClure et al. | |
| 6,095,163 A | | 8/2000 | McClure et al. | |

FOREIGN PATENT DOCUMENTS

| | | | |
|---|---|---|---|
| EP | 309432 | * | 3/1989 |

* cited by examiner

*Primary Examiner*—Charles Boyer
(74) *Attorney, Agent, or Firm*—DeLio & Peterson, LLC

(57) ABSTRACT

A method and biological cleaning system are provided for cleaning substrate surfaces of oils and/or greases using a biological cleaning system which utilizes a pre-treatment bath and/or post-treatment bath as part of the cleaning system. The pre-treatment and/or post-treatment baths are compatible with the biological cleaning bath and during operation of the system, the used pre-treatment and/or post-treatment baths are recycled to the biological cleaning solution for biodegradation. A system is provided in which none of the pre-treatment, post-treatment or biological cleaning baths need expensive waste disposal. Replenishment pre-treatment and/or post-treatment baths as well as biological cleaning baths are added as needed to the biological cleaning system. Other treatment baths may be added directly to the biological cleaning bath with or without pre- or post-treatment for specific purposes such as a detergent phosphating bath used in the biological cleaning tank to provide a cleaned phosphated part.

4 Claims, 1 Drawing Sheet

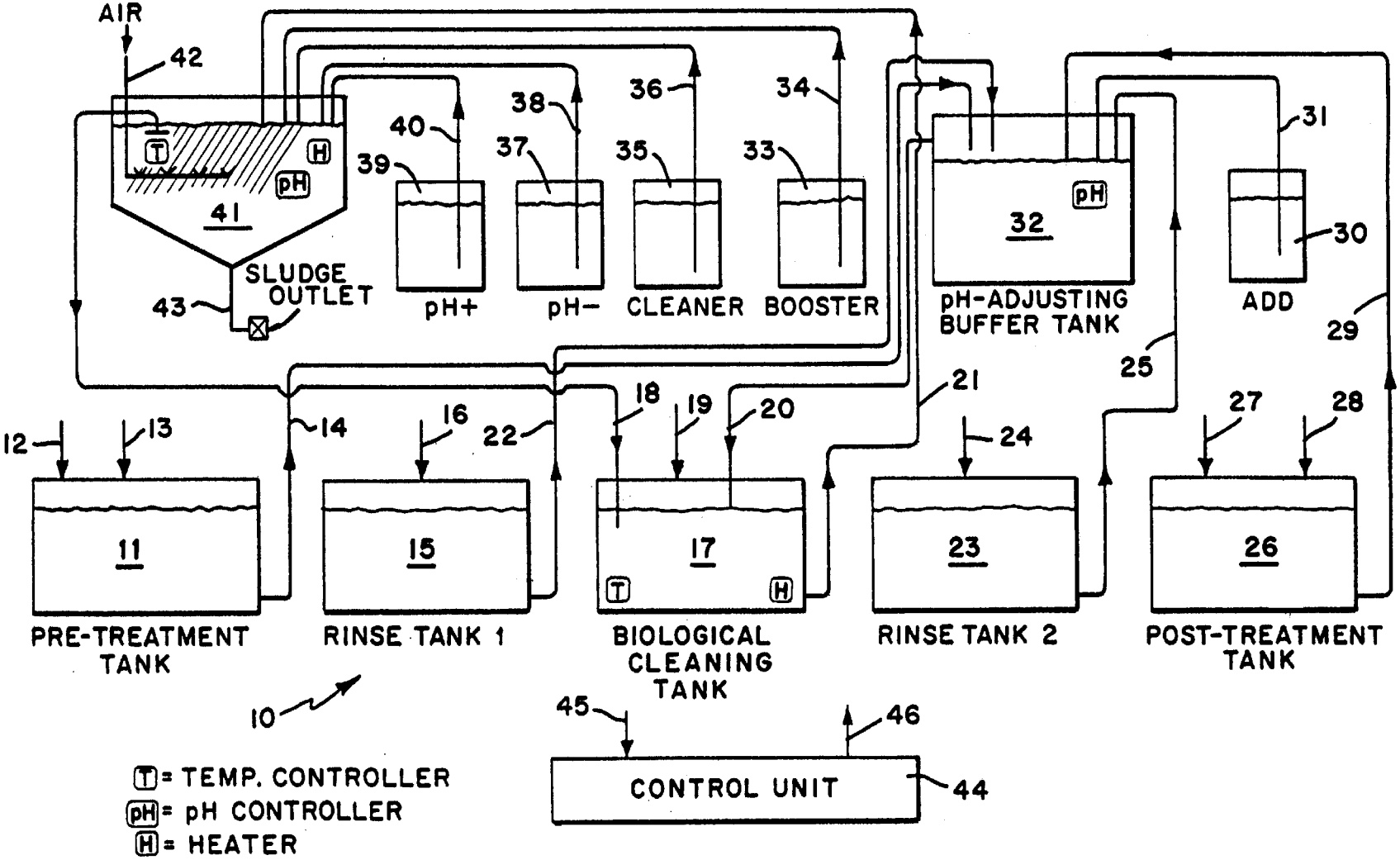
ADD
30
31
29
28
27
26
POST-TREATMENT TANK
25
pH-ADJUSTING BUFFER TANK
32
pH
24
23
RINSE TANK 2
21
44
46
BOOSTER
33
34
20
17
BIOLOGICAL CLEANING TANK
CONTROL UNIT
CLEANER
35
36
19
18
45
pH−
37
38
22
16
15
RINSE TANK 1
pH+
39
40
14
SLUDGE OUTLET
41
43
42
AIR
13
11
PRE-TREATMENT TANK
12
10
T = TEMP. CONTROLLER
pH = pH CONTROLLER
H = HEATER

BIOLOGICAL CLEANING SYSTEM WHICH FORMS A CONVERSION COATING ON SUBSTRATES

BACKGROUND OF THE INVENTION

1. Field of the Invention

The present invention relates generally to cleaning contaminants such as oil and grease from the surface of substrates such as metal and plastic parts using a biological cleaning system which cleans the parts and digests the contaminants so that the cleaning solution is maintained in an active state over an extended cleaning time period and, in particular, to the use of a combination cleaning and treating bath and/or a recycle pre-treatment and/or post-treatment bath to provide an efficient and cost effective integrated biological cleaning system.

2. Description of Related Art

While microorganisms have been used for many years to digest oil from wastes and spills, the integration of biodegradation with aqueous cleaning for metal and other material finishing applications is a relatively recent process. Mild alkaline emulsifying cleaners that operate at relatively low temperatures are now used to integrate the removal of oil and particulates in a parts cleaning operation with biological digestion of the residues. The system is essentially self-regulating, since the microbial activity will adjust itself to the amount of removed oil and grease present in the system.

In a typical system used in the metal finishing industry, an alkaline cleaning solution and control system is employed that utilizes microbes in the solution to consume the oil/grease that is removed from parts during the cleaning process. The system operates at relatively low temperatures (104° F.–131° F.) (40° C.–55° C.) and a pH range of 8.8–9.2, which is a viable habitat for the microorganisms. The cleaning process actually takes place in two separate operations. When parts come in contact with the solution, the oil and impurities are emulsified into micro-particulates. The micro-particulates are then consumed by microorganisms which are present in the bath. The microbe consumption of the oil present in the bath, as its food source, results in the production of $CO_2$ as a by-product. The microbes are naturally present in industrial oils and greases, and the main species responsible for biodegradation has been identified as pseudomonas stutzeri, a microorganism found in soil and water.

In one process operation, the cleaning solution from a cleaning tank is pumped continuously between a separator module and the cleaning tank. This operation is run in a continuous mode without interruptions for solution dumping and new solution make-up. As a result of the dynamics of the process and the re-circulation of the bath solution, the consumption of oil by the microbes occurs throughout the biological degreasing system. For an efficient operation the oil must be emulsified and oil must be present at all times to keep an active population of microorganisms. In the case of a longer interruption that may be conducive to the total depletion of the oil present in the system, to keep the microbes alive it is necessary to render them dormant typically by increasing the pH to 10.5 or alternatively, to feed them with small amounts of oil during the down time.

The typical system is managed by a control unit which controls the process parameters such as temperature and pH, and the replenishment of surfactants and nutrients, maintaining the chemical and biological equilibrium. It is possible to operate the system without downtime for extended periods (up to many years), eliminating the need of dumping spent cleaning solutions. The enhanced productivity and the reduced use of chemicals and water have made the system well suited to fulfill the present needs of the industry.

Biological cleaning systems offer many advantages over conventional chemical cleaners. The life of the cleaning solutions have been lengthened to the point that today there are many operations where the original cleaning solution is in use many years after installation. Biological cleaning process also creates practically no solid or liquid waste that requires treatment and disposal. The degreasing processes are also more effective since the parts are treated with a cleaning solution that is continuously rejuvenated and always has about the same composition and a consistent oil removal ability. Biological cleaning systems offer major economies savings in chemicals, labor, waste disposal and energy costs.

The biological cleaning systems used today have been adapted to the requirements of a broad range of industrial applications, and currently the process is used in electroplating, painting, powder coating anodizing and general metal and plastic working operations.

While biological cleaning has proven its effectiveness in a large number of installations, under certain conditions the parts to be cleaned must be pre or post treated and/or are not totally cleaned since contaminants still remain on the surface. This requires further steps to specially treat or clean the part which affects the cost effectiveness of the total part treating process. One particular application is the need to provide a clean, phosphated part for further processing, such as painting. This process now requires a number of non-integrated steps. In another application, parts which have been cleaned or partially cleaned in a biological cleaner are now post-treated by electrocleaning in an electrocleaner bath. This process likewise now requires a number of non-integrated steps.

Bearing in mind the problems and deficiencies of the prior art, it is therefore an object of the present invention to provide a method for cleaning substrate surfaces in which the parts are cleaned to commercial standards and which substrates may also be pre or post treated, i.e., phosphated, electrocleaned, etc. for further downstream processing.

It is another object of the present invention to provide a biological cleaning system for cleaning substrate surfaces which provides parts cleaned to commercial standards and which parts may also be pre or post treated, i.e., phosphated, electrocleaned, etc. for further downstream operations.

In another object of the present invention a method and apparatus are provided for providing cleaned, treated parts in a single step cleaning and treating bath such as a detergent phosphating bath, which bath may be used with or without the pre- or post-treatment steps described above.

Still other objects and advantages of the invention will in part be obvious and will in part be apparent from the specification.

SUMMARY OF THE INVENTION

The above and other objects, which will be apparent to those skilled in art, are achieved in the present invention which is directed to a method for cleaning and/or treating substrate surfaces comprising the steps of:

providing a biological cleaning bath comprising a surfactant for cleaning and emulsifying oils and/or greases on a substrate surface and microbes for digesting the emulsified oils and/or greases;

providing a pre-treatment bath for pre-treating the substrate to be cleaned, the pre-treatment bath comprising a composition which is biologically compatible with the cleaning bath;

immersing the substrate to be cleaned in the pre-treatment bath for a sufficient time to pre-treat the substrate;

removing the pre-treated substrate from the pre-treatment bath and immersing the pre-treated substrate in the biological cleaning bath for a sufficient time to clean the substrate;

removing the biologically clean substrate from the biological cleaning bath;

periodically or continuously removing a portion of the pre-treatment bath and adding the removed portion to the biological cleaning bath where the components of the bath are digested by the microbes;

replenishing the pre-treatment bath; and continuing the above steps until the desired number of substrates are cleaned.

In another aspect of the invention a method is provided for cleaning and/or treating substrate surfaces comprising the steps of:

providing a biological cleaning bath comprising a surfactant for cleaning and emulsifying oils and/or greases on a substrate surface and microbes for digesting the emulsified oils and/or greases;

providing a post-treatment bath for post-treating the substrate to be cleaned, the post-treatment bath comprising a composition which is biologically compatible with the cleaning bath;

immersing the substrate to be cleaned in the biological cleaning bath for a sufficient time to clean the substrate;

removing the cleaned substrate from the biological cleaning bath and immersing the cleaned substrate in the post-treatment bath for a sufficient time to post-treat the substrate;

removing the post-treated substrate from the post-treatment bath;

periodically or continuously removing a portion of the post-treatment bath and adding the removed portion to the biological cleaning bath;

replenishing the post-treatment bath; and continuing the above steps until the desired number of substrates are cleaned and post treated.

In an additional aspect of the invention a method is provided for cleaning and/or treating substrate surfaces comprising the steps of:

providing a biological cleaning bath comprising a surfactant for cleaning and emulsifying oils and/or greases on a substrate surface and microbes for digesting the emulsified oils and/or greases;

providing a pre-treatment bath for pre-treating the substrate to be cleaned and a post-treatment bath for post treating the cleaned substrate, the pre-treatment bath and post-treatment each comprising a composition which is compatible with the cleaning bath;

immersing the substrate to be cleaned in the pre-treatment bath for a sufficient time to pre-treat the substrate;

removing the pre-treated substrate from the pre-treatment bath and immersing the pre-treated substrate in the biological cleaning bath for a sufficient time to clean the substrate;

removing the biologically clean substrate from the biological cleaning bath;

immersing the cleaned substrate in the post-treatment bath for a sufficient time to post-treat the substrate;

removing the post-treated substrate from the post-treatment bath;

periodically or continuously removing a portion of the pre-treatment bath and post-treatment bath and adding the removed portions to the biological cleaning bath;

replenishing the pre-treatment bath and post-treatment bath; and continuing the above steps until the desired number of substrates are pre-treated, cleaned and post-treated.

In a further aspect of the invention a method is provided for cleaning and treating substrate surfaces comprising the steps of:

providing a biological cleaning and treating bath comprising a surfactant for cleaning and emulsifying oils and/or greases on a substrate surface, microbes for digesting the emulsified oils and/or greases and a compatible treatment composition such as an iron phosphating composition;

immersing the substrate to be cleaned and treated in the biological cleaning and treating bath for a sufficient time to clean and treat the substrate;

removing the cleaned and treated substrate from the biological cleaning and treating bath;

continuing the above steps until the desired number of substrates are cleaned and treated.

In a further aspect of the invention a biological cleaning system is provided comprising:

a tank containing a biological cleaning bath comprising a surfactant for cleaning and emulsifying oils and/or greases on a substrate surface and microbes for digesting the emulsified oils and/or greases;

a tank containing a pre-treatment bath for pre-treating the substrate to be cleaned, the pre-treatment bath comprising a composition which is compatible with the cleaning bath;

means for transferring a portion of the pre-treatment bath from the pre-treatment tank to the biological cleaning tank;

means for replenishing the pre-treatment bath;

wherein substrates to be cleaned are immersed in the pre-treatment bath for a sufficient time to pre-treat the substrate and then removed from the pre-treatment bath and immersed in the biological cleaning bath for a sufficient time to clean the substrate and a portion of the pre-treatment bath is removed either periodically or continuously and transferred to the biological cleaning bath where contaminants in the transferred pre-treatment bath are digested by the microbes.

In an additional aspect of the invention a biological cleaning system is provided comprising:

a tank containing a biological cleaning bath comprising a surfactant for cleaning and emulsifying oils and/or greases on a substrate surface and microbes for digesting the emulsified oils and/or greases;

a tank containing a pre-treatment bath, the pre-treatment bath comprising a composition which is compatible with the cleaning bath;

a tank containing a post-treatment bath for post-treating a cleaned substrate, the post-treatment bath comprising a composition which is compatible with the cleaning bath;

means for transferring part of the pre-treatment bath from the pre-treatment tank to the biological cleaning tank;

means for transferring a portion of the post-treatment bath from the post-treatment tank to the biological cleaning tank;

means for replenishing both the pre-treatment bath and the post-treatment bath;

wherein substrates to be cleaned and post-treated are immersed in the pre-treatment bath to pre-treat the substrate, the pre-treated substrate then being immersed in the cleaning bath to clean the substrate and then immersed in the post-treatment bath to post-treat the substrate and periodically or continuously removing a portion of the pre-treatment and post-treatment bath and transferring the removed portions to the biological cleaning bath where contaminants in the pre-treatment bath and post-treatment bath are digested and replenishing the pre-treatment bath and post-treatment bath as needed.

In a further aspect of the invention a biological cleaning system is provided comprising:

a tank containing a biological cleaning bath comprising a surfactant for cleaning and emulsifying oils and/or greases on a substrate surface and microbes for digesting the emulsified oils and/or greases;

a tank containing a post-treatment bath for post-treating a cleaned substrate, the post-treatment bath comprising a composition which is compatible with the cleaning bath;

means for transferring a portion of the post-treatment bath from the post-treatment tank to a biological cleaning tank;

means for replenishing the post-treatment bath;

wherein a substrate to be post-treated is immersed in the biological cleaning bath for a sufficient time to clean the substrate and then removed and immersed in the post-treatment bath for a sufficient time for post-treating the substrate and a portion of the post-treatment bath is periodically or continuously removed from the post-treatment tank and added to the biological cleaning tank where contaminants in the post-treatment bath are digested and the post-treatment bath is replenished as needed.

In another aspect of the invention a biological cleaning and treating system is provided comprising:

a tank containing a biological cleaning and treating bath comprising a surfactant for cleaning and emulsifying oils and/or greases on a substrate surface, microbes for digesting the emulsified oils and/or greases and a compatible treating composition such as an iron phosphating composition;

wherein a substrate to be cleaned and treated is immersed in the biological cleaning and treating bath for a sufficient time to clean and treat the substrate and then removed.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

The FIGURE is a flow diagram of a biological cleaning system of the invention.

DESCRIPTION OF THE PREFERRED EMBODIMENT(S)

In describing the present invention, reference will be made herein to the FIGURE of the drawings in which like numerals refer to like features of the invention.

The consumption of emulsified oil in the cleaning process by microorganisms is essentially bioremediation. In the simplest terms, bioremediation is the use of microorganisms (fungi or bacteria) to decompose pollutants into less harmful compounds. Bioremediation is the technological application of biodegradation and biodegradation is a natural process by which microbes alter and break down petroleum hydrocarbons, natural oils and fats into other substances. The resulting products can be carbon dioxide, water, and partially oxidized biologically inert by-products. Bacteria that consume petroleum are known as hydrocarbon oxidizers because they oxidize compounds to bring about degradation.

Bioremediation is the optimization of biodegradation and optimization can be accomplished by fertilizing (adding nutrients) and/or seeding (adding microbes). These additions are necessary to overcome certain environmental factors that may limit or prevent biodegradation.

Microbes attack hydrocarbon molecules, such as oil, causing degradation and the degradation of oil relies on having sufficient microbes to degrade the oil through the microbes' metabolic pathways (series of steps by which degradation occurs). Nature has evolved many microbes to do this job. Throughout the world there are over 70 genera of microbes that are known to degrade hydrocarbons, which account for only 1% of the natural populations of microbes. The bacteria utilized by the biological cleaning process are preferably pseudomonas stutzeri although any suitable microbe can be used. However, even when these microbes are present, degradation of hydrocarbons can take place only if all other basic requirements of the microbes are met.

Bacteria differ dramatically with respect to the conditions that allow their optimal growth. In terms of nutritional needs, all cells require carbon, nitrogen, phosphorus, sulfur, numerous inorganic salts (potassium, magnesium, sodium, calcium, and iron), and a large number of other elements called micronutrients. The survival of a microorganism depends on whether or not it can meet its nutritional needs.

Carbon is the most basic structural element of all living forms and is needed in greater quantities than other elements. The nutritional requirement ratio of carbon to nitrogen is 10:1, and carbon to phosphorus is 30:1. Organic carbon is a source of energy for microbes because it has high energy yielding bonds in many compounds. In the decomposition of oil, there is plenty of carbon for the a microorganism due to the structure of the oil molecule.

Nitrogen is found in the proteins, enzymes, cell wall components, and nucleic acids of microorganisms and is essential for microbial metabolism. Because only a few microorganisms can use molecular nitrogen, most microorganisms require fixed forms of nitrogen, such as organic amino nitrogen, ammonium ions, or nitrate ions. These other forms of nitrogen can be scarce in certain environments, causing nitrogen to become a limiting factor in the growth of microbial populations.

Phosphorous is needed in the membranes (composed of phospholipids), ATP (energy source of cell) and to link together nucleic acids.

Along with nutrients, microbes need certain conditions to live. Microbial growth and enzymatic activity are affected by stress ultimately impacting the rate of biodegradation. As the stress increases (less favorable conditions occur) the microbes have a harder time living in their environment. There is a certain range of conditions in which microbes can live. As conditions reach the extremes microbial growth slows down, but when conditions are perfect the microbial community can thrive.

Oxygen is needed since biodegradation is predominantly an oxidation process known as heterotrophic metabolism. Bacteria enzymes will catalyze the insertion of oxygen into the hydrocarbon so that the molecule can subsequently be consumed by cellular metabolism. Because of this, oxygen is one of the most important requirements for the biodegradation of oil. The primary source of oxygen for biodegradation is atmospheric oxygen. Aeration is required to allow biodegradation to take place. Oxygen is important in hydrocarbon degradation because the major pathways for both saturated and aromatic hydrocarbons involve molecular oxygen or oxygenases. Theoretical calculations show that 3.5 gram (g) of oil can be oxidized for every gram of oxygen present.

Biodegradation can also occur under anaerobic conditions by processes called anaerobic respiration, in which the final electron acceptor is some other inorganic compound, such as nitrates, nitrites, sulfates, or carbon dioxide. The energy yields available to the cell using these acceptors are lower than in respiration with oxygen—much lower in the case of sulfate and carbon dioxide—but they are still substantially higher than from fermentation.

Water is needed by microorganisms since it makes up a large proportion of the cell's cytoplasm. Water is also important because most enzymatic reactions take place in solution. Water is also needed for transport of most materials into and out of the cell.

Several variables, including pressure, concentration, temperature and pH may also have important effects on biodegradation rates. Bacteria have adapted to a wide range of temperatures and although hydrocarbon degradation has been found to occur at a wide range of temperatures (as low as below 0° C. to as high as 70° C.), temperature control is an important factor on the rate of biodegradation.

Raising the temperature will increase the possibility of reactions taking place and increase the rate of diffusion. Without reactions and diffusion life cannot exist. In general the rate of enzymatic reactions can be doubled for every 10° C. rise in temperature as long as the enzymes are not denatured. The higher the rate of the enzymatic reactions the faster the biodegradation will occur. However, there is a maximum temperature at which these microorganisms successfully survive. While higher temperatures are conducive to cleaning, temperatures in excess of 60° C. will typically kill the bacteria. For this reason the temperatures for biological cleaning are typically maintained between 40° C. and 57° C. (104–131° F.).

In the biological cleaning process the pH of the cleaner is also an important variable and it is maintained in a relatively narrow range of 8.8 to 9.2. At pH values above this limit the microbial activity decreases, while at lower pH values the microbe population will grow too fast and will consume not only the oils present but also the biodegradable surfactant needed for cleaning. It will be appreciated however that any suitable pH may be used.

The concentration of pollutants is an important factor. If the concentration of petroleum hydrocarbons is too high then it will reduce the amount of oxygen, water and nutrients that are available to the microbes. This will create an environment where the microbes are stressed thereby reducing their ability to break down the oil.

Once the necessary requirements are present either naturally or by addition, the oil can begin to be broken down by the microbes. Favorable conditions for the microbes will help optimize the degradations of the oil. The degradation of these hydrocarbons occurs in certain steps and can be represented by metabolic pathways.

There is a multitude of types of oils. The difference in composition determines the quality of any particular oil. Petroleum is a complex mixture of hydrocarbons, but it can be fractionated into aromatics, aliphatics, asphaltics and a small portion of non-hydrocarbons compounds. Over the last 20 years complex chemical equations have been derived to describe the metabolic pathways in which oil is broken down. The general outline bioremediation pathways for aliphatic and aromatic hydrocarbons have been formulated and continue to be developed in greater detail with time. All of these pathways will result in the oxidation of at least part of the original hydrocarbon molecule. The content of a particular petroleum mixture will also influence how each hydrocarbon will degrade and the type and size of each hydrocarbon molecule will determine the susceptibility to biodegradation.

With regard to the Figure, a biological cleaning system of the invention is shown generally as 10. The system has a pre-treatment tank 11 which contains a pre-treatment solution. The pre-treatment solution may be replenished through line 12 as needed. The initial parts to be cleaned 13 are immersed in the pre-treatment solution in the pre-treatment tank to pre-treat the parts. The pre-treatment solution when either spent or in another intermediate state of use is transferred to pH-adjusting buffer tank 32. The transfer is preferably continuously but may be intermittent as needed. The purpose of pH-adjusting buffer tank 32 is to adjust the pH of solutions entering the tank with the combined solution in the buffer tank 32 being transferred to biological cleaning tank 17 through line 20. It should be noted at this point that solutions from all the treatment and/or rinse tanks in the system are preferably fed into pH-adjusting buffer tank 32 for adjustment before being fed into biological cleaning tank 17 for digestion. The rinse solutions may be sent directly to waste if desired.

The pre-treated parts now identified as numeral 16 are then immersed in rinse tank 1 (15) to rinse the pre-treated parts. The rinse solution is typically water and is transferred from rinse tank 1 through line 22 to pH-adjusting buffer tank 32.

The rinsed parts now identified as numeral 19 are then immersed in biological cleaning or degreasing tank 17 to clean the parts. The biological cleaning solution is transferred preferably continuously from tank 17 through line 21 into separator 41 where sludge is removed through line 43. The biological cleaning solution is recycled back to biological cleaning tank 17 from separator 41 through line 18.

The parts after cleaning are now identified as numeral 24 and are immersed in rinse tank 2 (No. 23). Rinse solution is transferred through line 25 to pH-adjusting buffer tank 32.

The rinsed parts now identified as number 27 are immersed in post-treatment tank 26. Post-treatment solution is cycled to pH-adjusting buffer tank 32 through line 29. After post-treatment the parts are removed from post-treatment tank 26 and are final products.

As noted above, a number of input flow streams are added to pH-adjusting buffer tank 32 to adjust the pH of the various solutions entering the tank, which pH-adjusted solution is then transferred to biological cleaning tank 17 through line 20. Tank 30 is used to hold a pH adjustment material such as acid which is added to tank 32 through line 31 as needed.

A booster tank 33 is shown and is used to add booster components of the cleaning bath as needed to the cleaning solution through line 34 to separator 41. Similarly, additional cleaner material is held in tank 35 and added to separator 41 through line 36. Positive pH and negative pH adjusting means are provided in tanks 39 and 37, respectively, and may be added to separator 41 through lines 40 and 38, respectively. The above materials could be added to tank 17 instead but it is preferred to add them to separator 41.

Air is shown being added through line 42 into separator 41 to enhance biodegradation.

A control unit 44 is shown having an input shown collectively as numeral 45 and an output signal shown collectively as numeral 46. It will be appreciated by those skilled in the art that all of the above described tanks and other units have control and detector means associated therewith for providing input signals to control unit 44 through line 45 and for accepting output control signals 46. Depending on the input signal from a particular unit, the control unit 44 will send an output signal to the proper unit through line 46 to perform a required task such as adjusting the pH in the separator, controlling the temperature in the biological cleaning tank, adding replenisher to either the pre-treatment or post-treatment tank, and the like.

The control unit 44 is used to control operation of the complete system 10. Various input signals 45 to the control unit are used to calculate and determine the status of the system and output signals 46 are then produced to effect certain process changes.

Biological cleaning tank 17 can contain a cleaning and treating composition such as a detergent phosphating solution or other cleaning treating agent containing solution which will be used in certain processes to not only clean the parts but also to treat, e.g., phosphate, the parts for later treatment downstream such as painting. In this type process pre-treatment or post-treatment will not generally be used. It is contemplated herein that a number of biological compatible cleaning/treatment solutions may be used in biological cleaning tank 17 for specific purposes such as phosphating and similar conversion coatings.

With regard to the Figure, the biological cleaning system shown as 10 comprises both a pre-treatment of the initial parts to be cleaned and a post-treatment of the cleaned parts. It is contemplated herein that the initial parts can be either pre-treated in the treatment tank, cleaned or otherwise treated (phosphated) in the biological cleaning tank and then removed from the system or the initial parts can be first treated (cleaned) in the biological cleaning tank and then post-treated in the post-treatment tank and then removed from the system. The parts to be treated will determine the extent of any pre-treatment and/or post-treatment of the parts to be cleaned. It is an important feature of the invention however that the pre-treatment solution and/or post-treatment solution as well as treatment solutions used in the cleaning tank be compatible with the biological cleaning solution and be digested by the microbes in the biological cleaning solution. It is also contemplated herein that both cleaning and treating can be performed in the biological cleaning bath without any pre- or post-treatment. The methods provide a biological cleaning system in which parts can be treated completely in a number of ways in a closed system wherein no appreciable amount of waste is generated. For example, the pre-treatment solution since it is biologically compatible with the biological cleaning solution does not have to be separately treated and disposed. Similarly for the post-treatment solution and any combination cleaning and treating baths added to the cleaning tank.

In operating the above system, the various streams can be fed continuously or intermittently depending on the parts being processed, degree of cleaning desired, etc. It is preferred that the input streams from the process tanks (pre- and post-treatment and rinse tanks) to the buffer tank 32 be continuous.

The following examples are given for purposes of illustration only and are not to be considered as constituting or limiting the present invention. All parts and percentages given are by weight and temperatures in ° C. unless otherwise indicated.

Panel Preparation 1

Mild steel panels were covered with light machine oil and cleaned by immersion in a 5% by volume solution of BioClean 20/100 for 5minutes at 120° F. After rinsing in water the panel exhibited water breaks, and indicated a contaminated surface.

EXAMPLE 1

A cleaned panel prepared as indicated above was post-cleaned by treatment in an electrocleaner of the following composition:

| | |
|---|---|
| Potassium pyrophosphate | 0.75 g/l |
| Sodium metasilicate | 0.20 g/l |
| Sodium carbonate | 15.00 g/l |
| Trisodium carbonate | 15.00 g/l |
| Citric acid | 10.00 g/l |
| BioClean 20/100 | 2.5 ml/l |

The pH was adjusted to 9.0 with citric acid. After anodic electrocleaning for 60 seconds at 100° F., the panel did not show water breaks after rinsing.

The biological compatibility was determined by adding 500 ml of the electrocleaner to 500 ml of biologically active BioClean solution used above to clean the panels. After mixing for 2 hours a Hach Paddle Tester for total Bacterial Count was immersed and incubated for 100° F. for 24 hours exhibiting a level of activity in excess $10^7$.

EXAMPLE 2

A cleaned panel prepared as indicated above was post-cleaned by treatment in a soak cleaner of the following composition:

| | |
|---|---|
| Sodium hydroxide | 45 g/l |
| Sodium metasilicate | 36 g/l |
| Sodium tripolyphosphate | 5 g/l |
| Sodium carbonate | 4 g/l |
| Plurofac D 25 | 1 g/l |

After dipping the panel in this solution for 5 minutes at 200° F., no water breaks were found after rising.

The biological compatibility was determined by adding 100 ml of the soak cleaner (with a pH adjusted previously to pH 9 with phosphoric acid) to 900 ml of biologically active BioClean solution described above. After mixing for 2 hours a Hach Paddle Tester for total bacterial count was immersed and incubated for 100° F. for 24 hours exhibiting a level of activity in excess of $10^7$.

EXAMPLE 3

A cleaned panel prepared as indicated above was post-treated in an iron phosphating solution of the following composition:

| | |
|---|---|
| Sodium tripolyphosphate | 5 g/l |
| Phosphoric acid | 1 ml/l |
| Ammonium molybdate | 0.05 g/l |

The phosphating solution was adjusted to pH 5.5 and a bluish coating was obtained by immersion at room temperature for 7 minutes. The phosphated panel exhibited excellent paint adhesion by a standard cross-hatch test.

The biological compatibility was determined by adding 500 ml of the phosphating solution to 500 ml of biologically active BioClean solution described above. After mixing for 2 hours a Hach Paddle Tester for total bacterial count was immersed and incubated for 100° F. for 24 hours exhibiting a level of activity in excess of $10^7$.

Panel Preparation 2

Mild steel panels were covered with Extrudoil 51 and cleaned in a 5% by volume solution of BioClean 20/100 at 120° F., requiring 10 minutes of immersion to obtain a substantially oil free surface.

EXAMPLE 4

A mild steel panel covered with Extrudoil 51 as in panel preparation 2 was pre-cleaned by immersion in kerosene for 2 minutes and then treated with a 5% by volume solution of BioClean 20/100 at 120° F. After 2 minutes of immersion in the BioClean solution a substantially oil free surface was obtained.

The biological compatibility was determined by adding 100 ml of kerosene to 900 ml of biologically active BioClean solution described above. After mixing for 2 hours a Hach Paddle Tester for total bacterial count was immersed and incubated for 100° F. for 24 hours exhibiting a level of activity in excess of $10^7$.

When kerosene was replaced with 1 methyl 2 pyrrolidinone (m-pyrol), the biological compatibility of m-pyrol was determined by adding 100 ml of m-pyrol to 900 ml of biologically active BioClean solution described above. After mixing for 2 hours a Hach Paddle Tester for total bacterial count was immersed and incubated for 100° F. for 24 hours exhibiting zero biological activity, due to the unsuitability of m-pyrol.

EXAMPLE 5

A panel coated with Extrudoil 51 as in preparation 2 was pre-treated according to Example 4, immersed in a 5% Bioclean solution at 120° F. for 2 minutes and post-treated according to Example 1. A water break free surface was obtained after rinsing.

The biological compatibility was determined by adding 100 ml of kerosene and 100 ml of electrocleaner to 800 ml of biologically active BioClean solution described in Example 1. After mixing for 2 hours a Hach Paddle Tester for total bacterial count was immersed and incubated for 100° F. for 24 hours exhibiting a level of activity in excess of $10^7$.

EXAMPLE 6

An aluminum panel was coated with mechanical oil CG 80 and treated with a 5% by volume BioClean 20/100 by immersion for 5 minutes at 120° F., exhibiting water breaks after rinsing. By post-treating in a non-etching aluminum cleaner for 160° F. for 5 minutes a water break free surface was obtained. The composition of the aluminum cleaner was as follows:

| | |
|---|---|
| Sodium metasilicate | 18 g/l |
| Sodium tripolyphosphate | 18 g/l |
| Sodium carbonate | 5 g/l |
| Sodium bicarbonate | 3 g/l |
| Plurofac D 25 | 5 g/l |

The biological compatibility was determined by adding 100 ml of the aluminum cleaner (with a pH adjusted previously to pH 9 with phosphoric acid) to 900 ml of biologically active BioClean solution described above. After mixing for 2 hours a Hach Paddle Tester for total bacterial count was immersed and incubated for 100° F. for 24 hours exhibiting a level of activity of excess of $10^7$.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for cleaning and treating substrate surfaces comprising the steps of:

providing a biological cleaning and treating bath comprising a surfactant for cleaning and emulsifying oils and/or greases on a substrate surface, microbes for digesting the emulsified oils and/or greases and a compatible substrate treatment composition in an amount to treat the substrate and provide a treatment conversion coating thereon;

immersing the substrate to be cleaned and treated in the biological cleaning and treating bath for a sufficient time to clean and treat the substrate;

removing the cleaned and treated substrate from the biological cleaning and treating bath;

continuing the above steps until the desired number of substrates are cleaned and treated.

2. The method of claim 1 wherein the cleaning and treating bath contains phosphate treating components to form a phosphate conversion coating on the substrate.

3. A biological cleaning and treating system comprising:

a tank containing a biological cleaning and treating bath comprising a surfactant for cleaning and emulsifying oils and/or greases on a substrate surface, microbes for digesting the emulsified oils and/or greases and a compatible substrate treating composition in an amount to treat the substrate and provide a treatment conversion coating thereon;

wherein a substrate to be cleaned and treated is immersed in the biological cleaning and treating bath for a sufficient time to clean and treat the substrate and is then removed.

4. The system of claim 3 the cleaning and treating bath contain phosphate treating components to form a phosphate conversion coating on the substrate.

* * * * *